US010794381B2

(12) United States Patent
Dyer et al.

(10) Patent No.: US 10,794,381 B2
(45) Date of Patent: Oct. 6, 2020

(54) RECIPROCATING PUMP WITH IMPROVED CROSS-BORE

(71) Applicant: GARDNER DENVER PETROLEUM PUMPS, LLC, Tulsa, OK (US)

(72) Inventors: Robert James Dyer, Coweta, OK (US); Chris Lee Cackler, Jenks, OK (US); Paul Douglas Cary, Broken Arrow, OK (US)

(73) Assignee: GARDNER DENVER PETROLEUM PUMPS, LLC, Tulsa, OK (US)

( * ) Notice: Subject to any disclaimer, the term of this patent is extended or adjusted under 35 U.S.C. 154(b) by 381 days.

(21) Appl. No.: 15/497,543

(22) Filed: Apr. 26, 2017

(65) Prior Publication Data

US 2018/0313351 A1 Nov. 1, 2018

(51) Int. Cl.

| | |
|---|---|
| ***F04B 53/16*** | (2006.01) |
| ***F04B 49/22*** | (2006.01) |
| ***F04B 1/00*** | (2020.01) |
| ***F04B 19/22*** | (2006.01) |
| ***F04B 1/053*** | (2020.01) |
| ***F04B 1/0538*** | (2020.01) |
| *F04B 9/04* | (2006.01) |

(52) U.S. Cl.

CPC ..... *F04B 53/16* (2013.01); *F04B 1/00* (2013.01); *F04B 1/053* (2013.01); *F04B 1/0538* (2013.01); *F04B 19/22* (2013.01); *F04B 49/22* (2013.01); *F04B 9/045* (2013.01)

(58) Field of Classification Search

CPC .. F04B 53/16; F04B 1/00; F04B 1/053; F04B 1/0538; F04B 19/22; F04B 49/22; F04B 9/045; F04B 53/10; F04B 53/005

USPC ..... 417/559

See application file for complete search history.

(56) References Cited

U.S. PATENT DOCUMENTS

| | | | | |
|---|---|---|---|---|
| 6,544,012 | B1 * | 4/2003 | Blume | F04B 53/007 277/370 |
| 6,910,871 | B1 | 6/2005 | Blume | |
| 7,484,452 | B2 | 2/2009 | Baxter et al. | |
| 7,513,759 | B1 | 4/2009 | Blume | |
| 2004/0170507 | A1 | 9/2004 | Vicars | |
| 2008/0080994 | A1 | 4/2008 | Gambier et al. | |

(Continued)

FOREIGN PATENT DOCUMENTS

| | | |
|---|---|---|
| CN | 2572045 Y | 9/2003 |

*Primary Examiner* — Connor J Tremarche

(74) *Attorney, Agent, or Firm* — Michael Best & Friedrich LLP

(57) ABSTRACT

A well servicing pump includes a power end and a fluid end operably coupled to the power end. The fluid end includes a casing that defines at least one pumping chamber, the pumping chamber at least partially defined by a spherical wall, and a first cylindrical wall extending along a first axis and defining a portion of a power end bore, the first cylindrical wall intersecting the spherical wall to define a first interface edge. A second cylindrical wall extends along a second axis and defines a portion of a discharge bore, the second cylindrical wall intersecting the spherical wall to define a second interface edge, and a third cylindrical wall extends along a third axis and defines a portion of a suction bore, the third cylindrical wall intersecting the spherical wall to define a third interface edge, wherein the first axis, the second axis, and the third axis are arranged between 100 and 140 degrees with respect to one another.

20 Claims, 5 Drawing Sheets

(56) References Cited

U.S. PATENT DOCUMENTS

| | | | | |
|---|---|---|---|---|
| 2008/0152523 | A1 | 6/2008 | Jensen et al. | |
| 2012/0063936 | A1* | 3/2012 | Baxter | E21B 43/25 417/415 |
| 2014/0345452 | A1* | 11/2014 | Cary | F16J 10/02 92/169.1 |

* cited by examiner

RECIPROCATING PUMP WITH IMPROVED CROSS-BORE

BACKGROUND

Well Servicing pumps are commonly used to deliver fluids needed during drilling processes. Typical well servicing pumps include one or more reciprocating pistons that pressurize a fluid within a casing.

BRIEF SUMMARY

In one construction, a well servicing pump includes a power end and a fluid end operably coupled to the power end. The fluid end includes a casing that defines at least one pumping chamber, the pumping chamber at least partially defined by a spherical wall, and a first cylindrical wall extending along a first axis and defining a portion of a power end bore, the first cylindrical wall intersecting the spherical wall to define a first interface edge. A second cylindrical wall extends along a second axis and defines a portion of a discharge bore, the second cylindrical wall intersecting the spherical wall to define a second interface edge, and a third cylindrical wall extends along a third axis and defines a portion of a suction bore, the third cylindrical wall intersecting the spherical wall to define a third interface edge, wherein the first axis, the second axis, and the third axis are arranged between 100 and 140 degrees with respect to one another.

In another construction, a well servicing pump includes a power end and a fluid end coupled to and driven by the power end. The fluid end includes a casing that defines an internal space, the internal space consisting of a spherical bore space centrally located within the internal space, a power end bore intersecting with the spherical bore space, a discharge bore intersecting with the spherical bore space, and a suction bore intersecting with the spherical bore space. A piston is coupled to the power end and is operable in response to operation of the power end to reciprocate along a power end axis defined by the power end bore to cyclically draw fluid into the internal space via the suction bore and to discharge high pressure fluid via the discharge bore. A discharge valve is in fluid communication with the discharge bore and is operable to discharge high pressure fluid from the internal space, and a suction valve is in fluid communication with the suction bore and is operable to admit low pressure fluid into the internal space.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
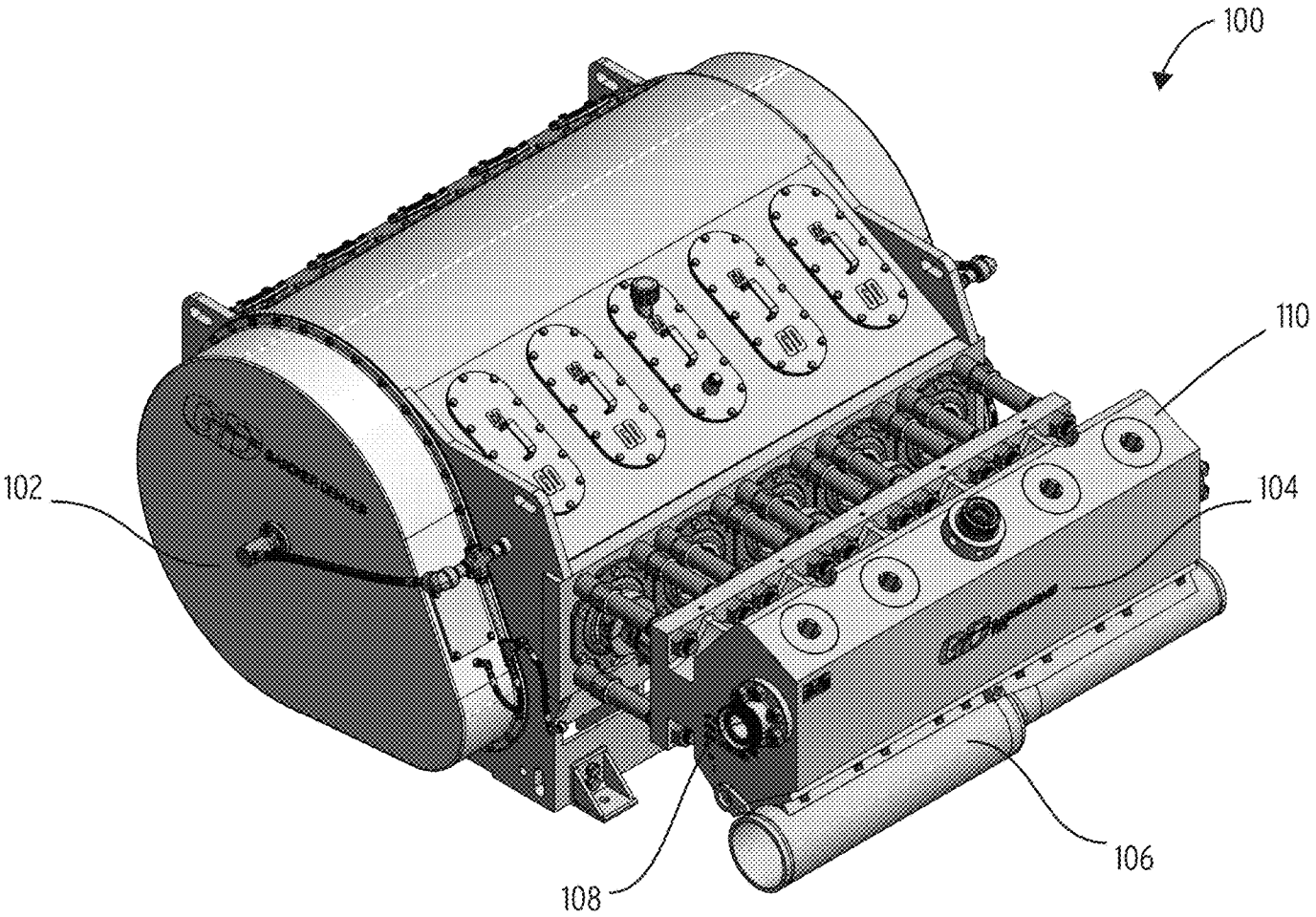
FIG. 1 is a perspective view of a well servicing pump.

FIG. 1 illustrates a well servicing pump 100 that includes a power end 102 and a fluid end 104. The power end 102 is arranged to drive a plurality of pistons or plungers to produce the desired pressure and flow rate from the fluid end 104. The design of the power end 102 is well known and will not be described herein in detail.

The fluid end 104 is attached to the power end 102 such that the power end 102 is able to drive the piston or plunger to cyclically pressurize the fluid end 104. In the illustrated construction, a one-piece casing 110 is used to support the components of the fluid end 104 required to provide five separate pumping chambers 404 (shown in FIG. 4), with other constructions including more or fewer pumping chambers 404 or separate casings for each pumping chamber 404. The casing 110 will be described in greater detail in FIG. 3 through FIG. 5.

The fluid end 104 also includes an intake manifold 106 (suction manifold) that provides a flow of low pressure fluid to the fluid end 104. A discharge manifold 108 is also provided to collect the fluid from the fluid end 104 after it has been pumped to a relatively high pressure. As is better illustrated in FIG. 2, the discharge manifold 108 is formed as part of the casing 110 and extends the length of the casing 110 to connect each of the discharge regions of the pumping chambers 404. By forming the discharge manifold 108 as part of the casing 110 the need for a high pressure external pipe is eliminated.

Figure 2:
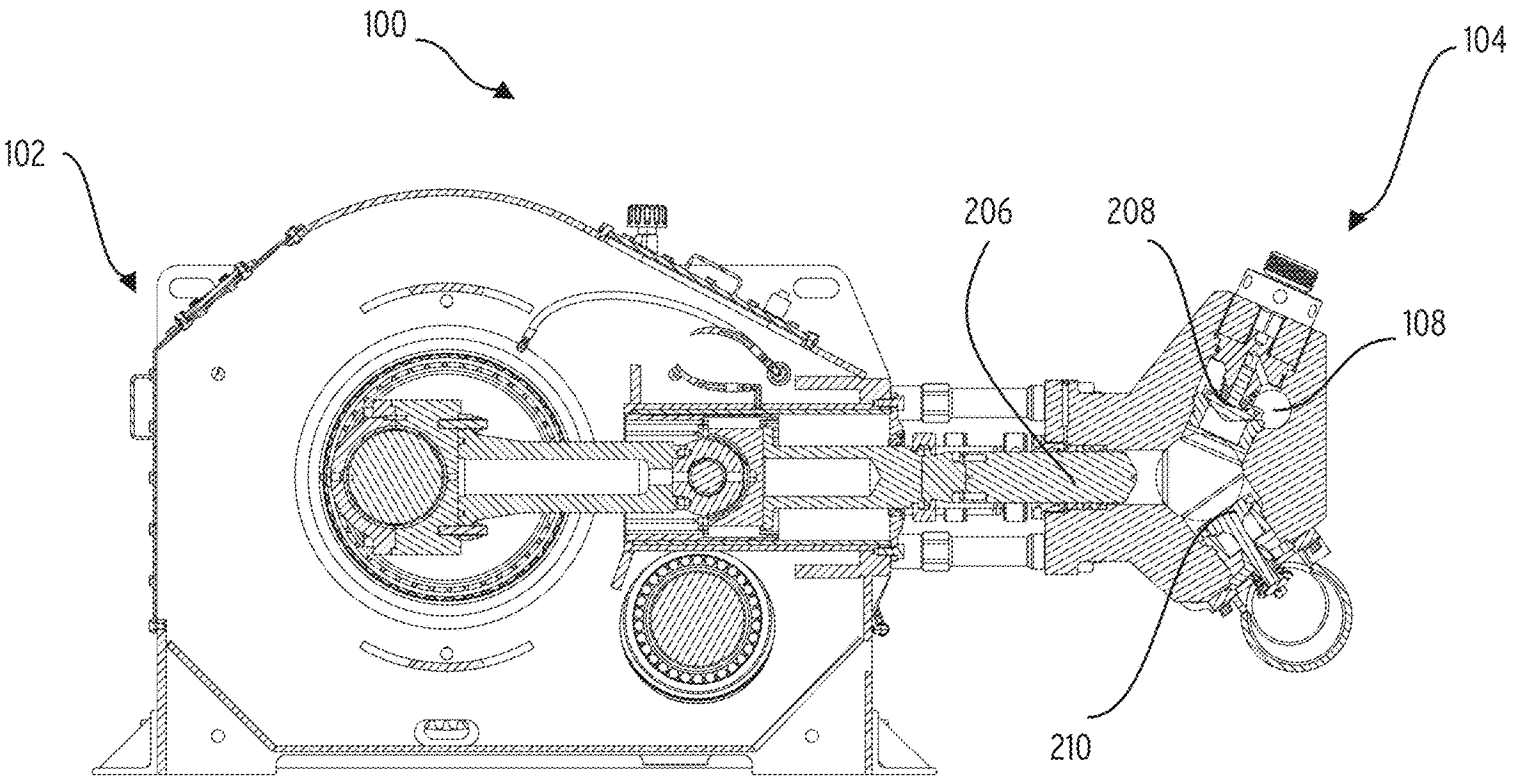
FIG. 2 is a section view of the well servicing pump of FIG. 1.

FIG. 2 is a cross section of the well servicing pump 100 of FIG. 1 and better illustrates some of the interior components. As illustrated, the power end 102 is arranged to drive a piston 206 along an axis in a reciprocating manner. As the piston 206 reciprocates, it cyclically pressurizes or depressurizes the fluid end 104.

The fluid end 104 includes at least one discharge valve 208 and at least one suction valve 210. Each suction valve 210 is in fluid communication with the intake manifold 106 to allow for the admission of relatively low pressure fluid into the fluid end 104. Retraction of the piston 206 produces suction within the fluid end 104 that opens the suction valve 210 and provides for the admission of the fluid.

Each discharge valve 208 is in fluid communication with the discharge manifold 108 to allow for the discharge of high pressure fluid from the fluid end 104. As the piston 206 moves toward the fluid end 104, the pressure within the fluid end 104 increases until the discharge valve 208 opens, at which time the fluid flows to the discharge manifold 108.

Figure 3:
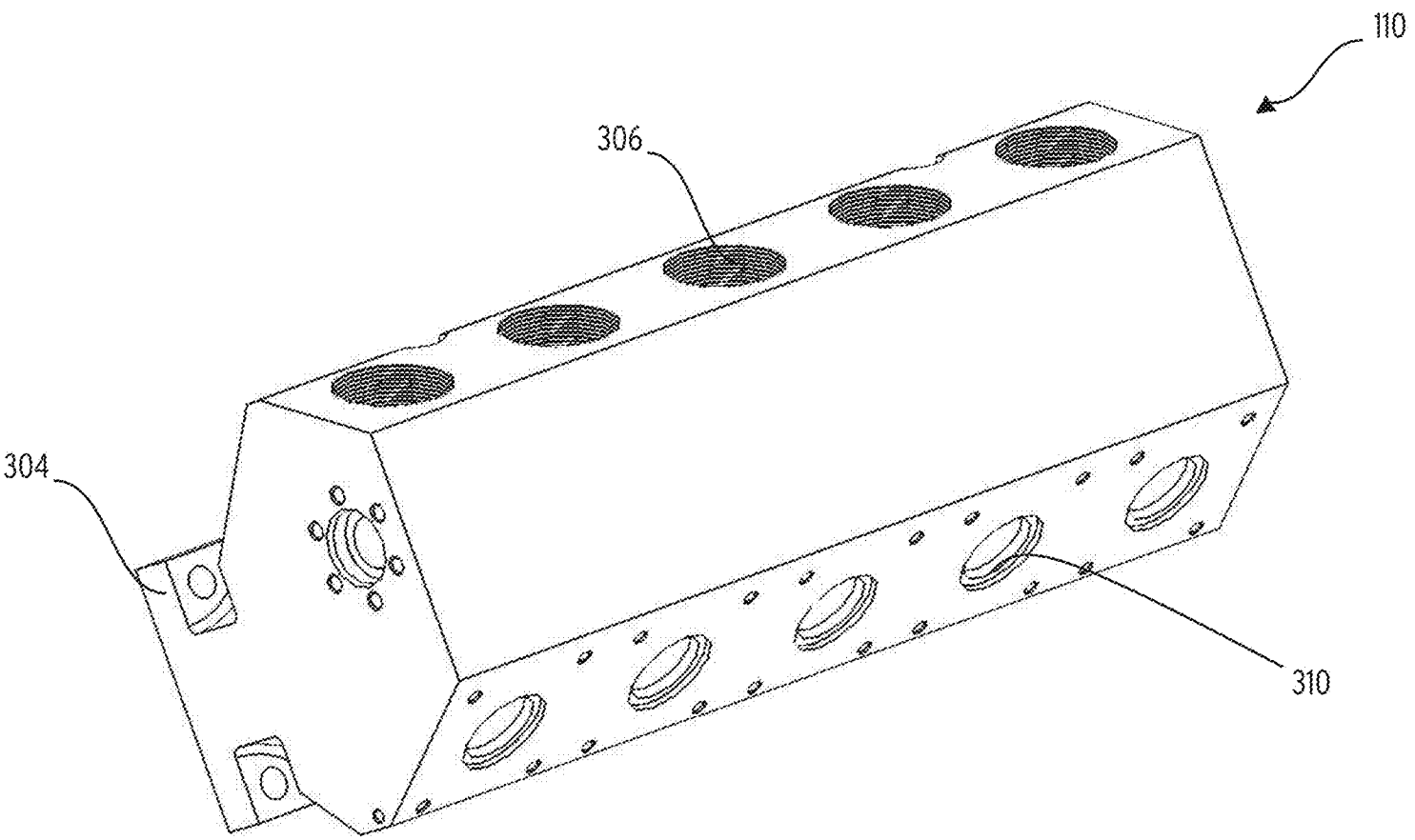
FIG. 3 is a perspective view of a fluid end casing suitable for use with the power end of FIG. 1.

FIG. 3 illustrates a casing 110 that can be used as part of the fluid end 104 of the well servicing pump 100 of FIG. 1. In the illustrated construction, the casing 110 is formed as a single piece (e.g., cast, forged, machined, etc.) and includes a flange 304 that facilitates the attachment of the casing 110 to the power end 102. In preferred constructions, the flange 304 includes a plurality of holes sized to receive bolts that facilitate the attachment, with other arrangements being possible.

In the illustrated construction, the casing 110 defines five suction bores 310 and five discharge bores 306 that each support a suction valve 210 or a discharge valve 208 as illustrated in FIG. 2. While the illustrated construction includes five suction bore 310 and discharge bore 306 combinations, other constructions could include fewer or more as may be required by the particular application. In one construction, the casing 110 includes a single suction bore 310 and a single discharge bore 306.

Figure 4:
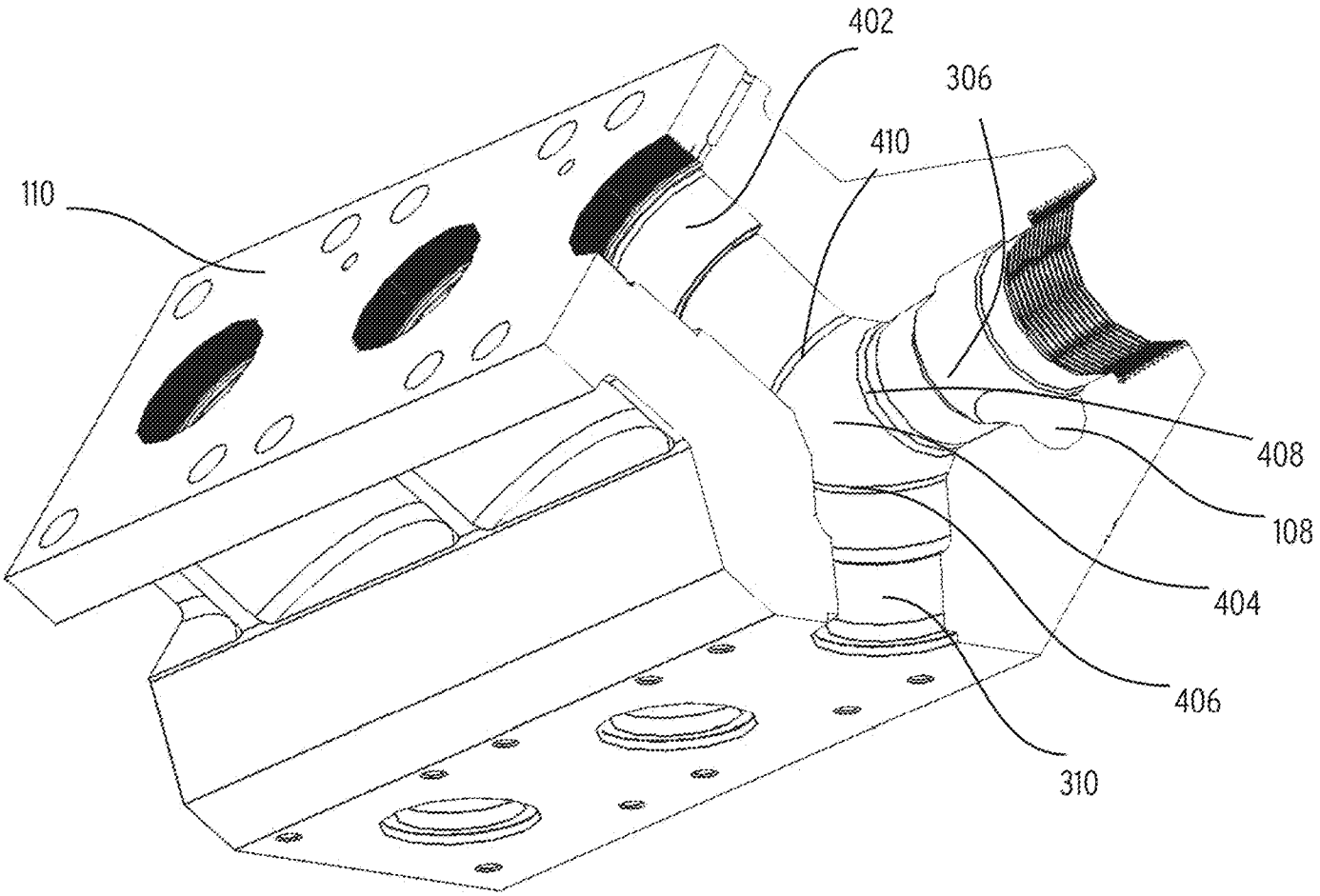
FIG. 4 is a perspective section view of the casing of FIG. 3.

Turning to FIG. 4, a cross section of the casing 110 taken through the center line of the central suction bore 310 better illustrates the interior of the casing 110. Each group of bores 306, 310 is similar to that illustrated in FIG. 4 and FIG. 5. As such, only one grouping will be discussed in detail.

In addition to the suction bore 310 and the discharge bore 306 already discussed, the casing 110 also defines a piston bore 402. The piston bore 402 is arranged to support any seals or bearings required to support the piston 206 for reciprocation.

Each of the suction bore 310, the discharge bore 306, and the piston bore 402 extends into the casing 110 and intersect with a pumping chamber 404. The pumping chamber is essentially a discrete space associated with one of the suction bores 310, the discharge bores 306, and the piston bores 402. Thus, each set of the suction bore 310, the discharge bore 306, and the piston bore 402 includes its own pumping chamber 404.

The casing 110 defines a surface that outlines a portion of the pumping chamber 404. The surface is formed such that it is spherical or substantially spherical. The suction bore 310 extends into the casing 110 and intersects with the pumping chamber 404. Thus, the surface that defines the suction bore 310 intersects with the spherical wall that defines the pumping chamber 404 and defines a first interface edge 406. Similarly, the discharge bore 306 extends into the casing 110 and intersects with the pumping chamber 404. Thus, the surface that defines the discharge bore 306 intersects with the spherical wall that defines the pumping chamber 404 and defines a second interface edge 408. Similarly, the piston bore 402 extends into the casing 110 and intersects with the pumping chamber 404. Thus, the surface that defines the piston bore 402 intersects with the spherical wall that defines the pumping chamber 404 and defines a third interface edge 410. In preferred constructions, the first interface edge 406, the second interface edge 408, and the third interface edge 410 are each broken, chamfered, filleted or otherwise modified to blend them into the adjacent surfaces and minimize any stress concentrations that may exist.

Figure 5:
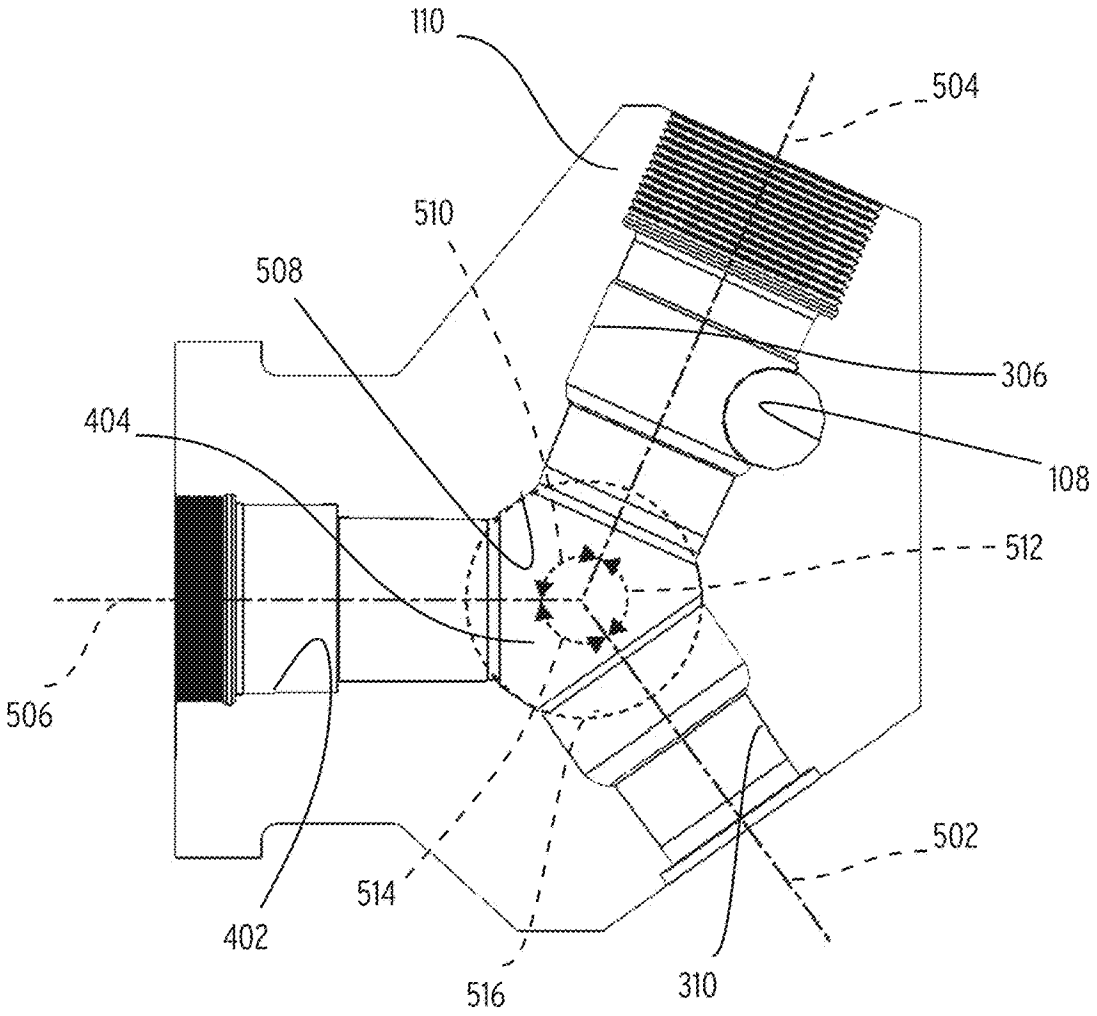
FIG. 5 is an end section view of the casing of FIG. 3.

FIG. 5 better illustrates the relationship between the suction bore 310, the discharge bore 306, and the piston bore 402. As illustrated, the suction bore 310 extends along a first axis 502 that passes through the center of an imaginary sphere 516 (shown in broken lines) that resides on the spherical wall 508. Similarly, the discharge bore 306 extends along a second axis 504 that also passes through the center of the imaginary sphere 516. The piston bore 402 is preferably arranged horizontally and extends along a third axis 506 that also intersects the center of the imaginary sphere 516 that resides on the spherical wall 508.

The suction bore 310, the discharge bore 306, and the piston bore 402 are arranged at angles with respect to one another that are defined by the respective axes 502, 504, 506. Specifically, the second axis 504 and the third axis 506 cooperate to define a first angle 510 therebetween. The first axis 502 and the second axis 504 cooperate to define a second angle 512 therebetween and the first axis 502 and the third axis 506 cooperate to define a third angle 514 therebetween. In preferred constructions, the first angle 510, the second angle 512, and the third angle 514, are about 120 degrees. However, other constructions may include arrangements in which the first angle 510, the second angle 512, and the third angle 514 fall between 100 degrees and 140 degrees.

It should be noted that terms such as "first", "second", and "third" are used simply for convenience and are not meant to imply any particular order or level of importance. In addition, the terms "about", "substantially", and like terms used herein are typically employed to account for manufacturing tolerances or other variations that might be common when manufacturing, assembling, or operating the components discussed herein.

In operation, the fluid end 104 is attached to the power end 102 and the power end 102 is driven by a prime mover such as an engine or an electric motor. In the illustrated construction, the power end 102 drives five separate pistons 206 that reciprocate to cyclically pressurize and de-pressurize five separate pumping chambers 404. Each pumping chamber 404, experiences a pressure drop as its associated piston 206 retracts from the fluid end 104. The pressure drop causes the suction valve 210 to open and draws low pressure fluid from the intake manifold 106 into the pumping chamber 404. As the piston 206 advances toward the fluid end 104, the fluid within the pumping chamber 404 is pressurized until it reaches a predetermined level that allows the discharge valve 208 to open. With the discharge valve 208 opened, the fluid is discharged to the discharge manifold 108.

As one of ordinary skill in the art will realize, each cycle of suction through pressurization creates a stress cycle in the casing 110. Specifically, the area around each pumping chamber 404 transitions from essentially zero stress during the suction process to a very high level of stress just prior to the opening of the discharge valve 208. If the well servicing pump 100 is operating at a relatively low speed of 100 RPM, each pumping chamber 404 will experience 6000 stress cycles per hour or 144,000 cycles per day. Any stress concentration increases the likelihood of cracking, which in turn increases the likelihood of a forced outage or forced maintenance cycle for the fluid end 104. The spherical wall 508 that at least partially defines the pumping chamber 404 greatly reduces the stress within the pumping chamber 404 and reduces or eliminates many of the typical stress concentrations. For example, the first interface edge 406, the second interface edge 408, and the third interface edge 410 are common locations of stress concentrations. However, the spherical wall 508 and the blending between the spherical wall 508 and the various bores greatly reduce this concentration.

Various features and advantages of the invention are set forth in the following claims.

What is claimed is:

1. A well servicing pump comprising:

a power end;

a fluid end operably coupled to the power end, the fluid end comprising:

a casing that defines at least one pumping chamber, the pumping chamber at least partially defined by a spherical wall;

a first cylindrical wall extending along a first axis and defining a portion of a power end bore, the first cylindrical wall intersecting the spherical wall to define a first interface edge;

a second cylindrical wall extending along a second axis and defining a portion of a discharge bore, the second cylindrical wall intersecting the spherical wall to define a second interface edge; and a third cylindrical wall extending along a third axis and defining a portion of a suction bore, the third cylindrical wall intersecting the spherical wall to define a third interface edge, wherein the first axis, the second axis, and the third axis are arranged between 100 and 140 degrees with respect to one another.

2. The well servicing pump of claim 1, wherein the fluid end is a first fluid end, and wherein a plurality of fluid ends are coupled to the power end.

3. The well servicing pump of claim 1, further comprising an intake manifold coupled to the fluid end and operable to deliver low pressure fluid to the suction bore.

4. The well servicing pump of claim 1, further comprising a discharge manifold coupled to the fluid end and positioned to receive high pressure fluid from the discharge bore.

5. The well servicing pump of claim 1, wherein the first axis, the second axis, and the third axis are arranged at 120 degrees with respect to one another.

6. The well servicing pump of claim 1, further comprising a suction valve disposed at least partially within the suction bore, the suction valve movable to an open position in response to a pressure within the pumping chamber below a first predetermined threshold to draw low pressure fluid into the pumping chamber.

7. The well servicing pump of claim 1, further comprising a discharge valve disposed at least partially within the discharge bore, the discharge valve movable to an open position in response to a pressure within the pumping chamber exceeding a second predetermined threshold to discharge high pressure fluid into the pumping chamber.

8. The well servicing pump of claim 1, wherein the casing is formed as a single piece and includes a plurality of pumping chambers, each spaced apart from one another, each pumping chamber including a spherical wall that defines a spherical bore space.

9. The well servicing pump of claim 1, wherein the first axis, the second axis, and the third axis intersect one another at a center defined by the spherical wall.

10. A well servicing pump comprising:

a power end;

a fluid end coupled to and driven by the power end, the fluid end comprising:

a casing that defines an internal space, the internal space consisting of:

a spherical bore space centrally located within the internal space;

a power end bore intersecting with the spherical bore space;

a discharge bore intersecting with the spherical bore space; and a suction bore intersecting with the spherical bore space;

a piston coupled to the power end and operable in response to operation of the power end to reciprocate along a power end axis defined by the power end bore to cyclically draw fluid into the internal space via the suction bore and to discharge high pressure fluid via the discharge bore;

a discharge valve in fluid communication with the discharge bore and operable to discharge high pressure fluid from the internal space; and a suction valve in fluid communication with the suction bore and operable to admit low pressure fluid into the internal space.

11. The well servicing pump of claim 10, wherein the fluid end is a first fluid end, and wherein a plurality of fluid ends are coupled to the power end.

12. The well servicing pump of claim 10, further comprising an intake manifold coupled to the fluid end and operable to deliver low pressure fluid to the suction bore.

13. The well servicing pump of claim 10, further comprising a discharge manifold coupled to the fluid end and positioned to receive high pressure fluid from the discharge bore.

14. The well servicing pump of claim 10, wherein the discharge bore defines a first axis and the suction bore defines a second axis, and wherein the first axis, the second axis, and the power end axis are arranged between 100 and 140 degrees with respect to one another.

15. The well servicing pump of claim 14, wherein the first axis, the second axis, and the power end axis are arranged at 120 degrees with respect to one another.

16. The well servicing pump of claim 14, wherein the first axis, the second axis, and the power end axis intersect at a center point defined by the spherical bore space.

17. The well servicing pump of claim 10, wherein the suction valve is movable to an open position in response to a pressure within the internal space falling below a first predetermined threshold to draw low pressure fluid into the internal space.

18. The well servicing pump of claim 10, wherein the discharge valve is movable to an open position in response to a pressure within the internal space exceeding a second predetermined threshold to discharge high pressure fluid into the internal space.

19. The well servicing pump of claim 10, wherein the casing is formed as a single piece that defines a plurality of internal spaces each spaced apart from one another, each internal space including a spherical wall that defines a spherical bore space.

20. The well servicing pump of claim 10, wherein the discharge valve is at least partially disposed within the discharge bore.

* * * * *